US009227340B2

(12) United States Patent
Turner

(10) Patent No.: US 9,227,340 B2
(45) Date of Patent: Jan. 5, 2016

(54) HANGING CONCRETE MIXER BARREL WIPER

(71) Applicant: Robert D. Turner, Chardon, OH (US)

(72) Inventor: Robert D. Turner, Chardon, OH (US)

(73) Assignee: Robert D. Turner, Chardon, OH (US)

( * ) Notice: Subject to any disclaimer, the term of this patent is extended or adjusted under 35 U.S.C. 154(b) by 0 days.

(21) Appl. No.: 14/533,207

(22) Filed: Nov. 5, 2014

(65) Prior Publication Data

US 2015/0121639 A1 May 7, 2015

Related U.S. Application Data

(60) Provisional application No. 61/899,905, filed on Nov. 5, 2013.

(51) Int. Cl.
*B28C 5/42* (2006.01)

(52) U.S. Cl.
CPC ..... *B28C 5/4244* (2013.01); *B28C 5/4203* (2013.01)

(58) Field of Classification Search
CPC ..... B28C 5/4244; B28C 5/4203
USPC ..... 366/52–63
See application file for complete search history.

(56) References Cited

U.S. PATENT DOCUMENTS

| | | | | |
|---|---|---|---|---|
| 2,576,457 | A * | 11/1951 | Henderson | B28C 5/4203 220/327 |
| 2,904,318 | A * | 9/1959 | Broberg | B28C 5/4262 366/41 |
| 3,198,495 | A * | 8/1965 | Maxon, Jr. | B28C 5/4244 298/22 R |
| 6,179,463 | B1 * | 1/2001 | Daniels-Romero | B28C 5/4262 366/349 |
| 6,957,908 | B1 * | 10/2005 | O'Connell | B28C 5/4262 366/41 |
| 2015/0121639 | A1 * | 5/2015 | Turner | B28C 5/4244 15/246 |

FOREIGN PATENT DOCUMENTS

| | | | | |
|---|---|---|---|---|
| DE | WO 2004113040 | A1 * | 12/2004 | B28C 5/4203 |

* cited by examiner

*Primary Examiner* — Charles Cooley
(74) *Attorney, Agent, or Firm* — Renner, Otto, Boisselle & Sklar, LLP

(57) ABSTRACT

An exemplary wiper assembly for use with a concrete mixer includes a wiper element configured to span a gap between a mixer barrel and a collector, and is configured for suspendedly coupling to a support frame separate from any coupling to the mixer barrel or the collector. One or more arm members are coupled between the concrete mixer and the wiper element. The arm member includes a tensioning portion that adjusts to move an upper edge of the wiper element into contact with the mixer barrel, and an elastic portion that enables the wiper element to adjust relative to each of the collector and the mixer barrel during rotation of the mixer barrel. Thus the wiper element has limited movement independent of rotation of the mixer barrel and of vibrational movement of the collector and mixer barrel due to movement of the concrete mixer over rough terrain, for example.

20 Claims, 4 Drawing Sheets

HANGING CONCRETE MIXER BARREL WIPER

RELATED APPLICATIONS

This disclosure claims the benefit of U.S. Provisional Application No. 61/955,327 filed Mar. 19, 2014, which is hereby incorporated herein by reference in its entirety.

FIELD OF INVENTION

The present invention relates generally to concrete mixers, and more particularly to a device for directing a flow of concrete upon discharge from a mixing barrel of a concrete mixer between the mixing barrel and a concrete collector.

BACKGROUND

Concrete mixers, which include front-discharge mixers and rear-discharge mixers, typically include a rotatable mixer barrel that may be supported by a support structure and rotated by a suitable prime mover, such as a motor. Rotatable members are often coupled between the support structure and the rotatable mixer barrel to assist in the rotation of the mixer barrel relative to the support structure. The support members may include movable members for translating or adjusting an angle of the barrel relative to a frame of the concrete mixer, which is often mounted on or incorporated into a vehicle, such as a concrete mixer truck. A cab, which may include both vehicle driving controls and rotatable mixer barrel controls, is often located generally directly below a discharge opening of the barrel in a front-discharge mixer, and generally at an opposite end of the associated vehicle frame from the discharge opening in a rear-discharge mixer.

Internal structures in the barrel are configured to move concrete, often in an upwards spiral, towards the discharge opening of the barrel when the barrel is rotated in a first discharge direction. The internal structure also is configured to prevent the concrete from moving towards the discharge opening of the barrel when the barrel is rotated in a direction opposite the first discharge direction. Concrete exiting the barrel drops into a concrete collector that in turn directs the concrete into a flow direction chute and then to the job site.

During the flow of the concrete from the barrel to the collector, some concrete may not flow into the collector and instead may run down an external surface of the barrel. This is wasteful and also can contaminate the movable members and antifriction wheels that support the barrel as well as other parts of the concrete mixer. Errant concrete also can fall onto the driver's cab roof or windows affecting visibility.

In the conventional response, a wiper typically is mounted to the collector. The wiper is often made of rubber, is arcuate in shape, and may be about 6 to 8 inches wide. The wiper often has a free edge which bears against the barrel. The opposite edge is fixedly coupled to the collector. For example, the coupled edge of the wiper is pressed against the top edge of the collector by a curved steel bar that is held in place by a plurality of bolts that pass through the bar, through the wiper, and through the collector, and are secured via nuts.

The collector, and thus the wiper, is supported by a platform that in turn is mounted to the support frame of the concrete mixer. The platform is supported from the support frame at a location separate from a location of engagement of the antifriction wheels that support the barrel relative to the support frame.

The support frame flexes not only when the concrete mixer is moved over, such as driven over, uneven surfaces, but also because the load of concrete moves around inside the barrel as the barrel rotates. As the support frame supporting the mixer flexes in response to these forces, the open end of the barrel having the discharge opening moves with respect to the collector and the wiper, which may cause a limited amount of concrete to fall to a side of the collector rather than into the collector. Also, contact between the barrel and the wiper changes, with one part of the wiper being compressed and an opposite side being relieved of pressure. A constant flexing and compression of the wiper in this manner causes the wiper to wear and require replacement to avoid additional dribbling of concrete onto external surfaces of the barrel, such as down the underside of the barrel, or onto the cab. When the wiper is replaced, the plurality of bolts that secure it to the collector must be removed, which is a challenging procedure because the nuts and bolts are often difficult to reach and are often coated with cured concrete.

SUMMARY OF INVENTION

Disclosed is a device for use on a concrete mixer to direct a flow of concrete from a rotatable mixer barrel to a collector of the concrete mixer, while preventing dripping of concrete between the mixer barrel and the collector. The exemplary concrete mixer includes the rotatable barrel with a discharge opening at one end and the collector disposed below the discharge opening. The collector has an upwardly facing collecting opening to receive concrete from the discharge opening. The concrete mixer also has a support frame to which the collector is mounted. The support frame may have oppositely disposed first and second members rising generally vertically each alongside the discharge opening of the barrel.

An exemplary wiper assembly device for use with the concrete mixer includes a wiper element configured to span a gap between the mixer barrel and the collector, and configured for coupling to the support frame separate from any coupling to the mixer barrel or collector, such that the wiper element suspends relative to each of the mixer barrel, the collector, and the support frame. One or more arm members couple the wiper element to the concrete mixer, such as to the support frame. The arm member includes a tensioning portion that adjusts to move an upper edge of the wiper element into contact with the mixer barrel, and an elastic portion that enables the wiper element to adjust relative to each of the collector and the mixer barrel during rotation of the mixer barrel. Thus the wiper element has limited movement independent of rotation of the mixer barrel and of vibrational movement of the collector and mixer barrel due to movement of the concrete mixer over rough terrain, for example.

Another exemplary wiper assembly for use with the concrete mixer includes a wiper element formed of a resilient material and having a first end, a second end, and an arcuate portion between the first and second ends. An upper edge of the arcuate portion of the wiper element is proportioned to engage the mixer barrel adjacent the discharge opening of the mixer barrel. The wiper element further includes a lower edge configured to be received within the upwardly facing opening of the collector. An elastic portion is coupled between one of the first and second ends and one of the first and second members and is tensioned by a tensioning portion coupled to the elastic portion to pull the upper edge of the arcuate portion of the wiper element into contact with the mixer barrel.

According to another embodiment, a wiper assembly is used with a concrete mixer having a rotatable barrel with a discharge opening at one end, a collector disposed below the discharge opening, the collector having an upwardly facing collecting opening to receive concrete from the discharge opening, and a support frame to which the collector is mounted. The wiper assembly includes a gap spanning portion that extends between a lower periphery of the rotatable barrel adjacent the discharge opening and an upper periphery of the collector adjacent the collecting opening. The gap spanning portion is configured for contact with each of the rotatable barrel and the collector. A first arm member couples a first lateral side of the gap spanning portion to the support frame, and a second arm member couples the support frame to a second lateral side of the gap spanning portion disposed opposite the first lateral side. One of the first and second arm members is selectively adjustable to align the gap spanning portion across a gap between the rotatable barrel and the collector. One of the first and second arm members is configured to suspend the gap spanning portion relative to the rotatable barrel and to the collector to allow side-to-side movement of the gap spanning portion along a lateral axis extending between the first and second lateral sides relative to the rotatable barrel and the collector.

One of the first and second arm members may include a tensioning portion that adjusts to move an upper edge of the gap spanning portion into contact with the rotatable barrel.

One of the first and second arm members may include an elastic portion that enables the gap spanning portion to adjust relative to each of the frame and the rotatable barrel during rotation of the rotatable barrel.

Each of the first and second arm members may include a tensioning portion that adjusts to move an upper edge of the gap spanning portion into contact with the rotatable barrel upon setting of a tension of the tensioning portion and an elastic portion that enables that gap expanding portion to adjust relative to each of the frame and the rotatable barrel during rotation of the rotatable barrel.

The gap spanning portion may have a length extending between the first and second lateral sides that is configured to extend laterally outwardly beyond the periphery of the rotatable barrel adjacent the discharge opening.

The gap spanning portion may include a resilient material.

The tensioning portion may include a zip tie.

The elastic portion may include an elastic loop extending between the support frame and the gap spanning portion.

The wiper assembly may further include fasteners that couple the first and second arms to the support frame.

The wiper assembly may further include extension members that extend between the support member and each of the first and second arm members, respectively, to limit side-to-side movement of the gap spanning portion relative to the support frame.

The gap spanning portion may include a lower edge that is configured to be fully received within the upwardly facing collecting opening of the collector.

The wiper gap spanning portion may have an upper edge having an arcuate shape and a lower edge having an arcuate shape.

The wiper assembly may be in combination with a concrete mixer having the rotatable barrel, the collector, and the support frame, wherein the wiper assembly is removably coupled to the support frame and an upper edge of the gap spanning portion is in contact with the rotatable barrel.

According to another exemplary embodiment, a wiper assembly is used with a concrete mixer having a rotatable barrel with a discharge opening at one end, a collector disposed below the discharge opening, the collector having an upwardly facing collecting opening to receive concrete from the discharge opening, and a support frame to which the collector is mounted. The wiper assembly includes a concrete direction member having an arcuate upper edge configured to extend about a periphery of the rotatable barrel adjacent the discharge opening, a lower edge configured to be received into the collecting opening and to conform to a contour of an inner surface of the collector, and a center portion extending between the upper and lower edges that is configured to cover a gap spanning between the rotatable barrel and the collector. An arm member is coupled to the concrete direction member and to the support frame. The arm member has an elastic portion configured to extend and retract and a tensioning portion configured to selectively adjust alignment of the concrete direction member relative to the collector. The arm member is configured to enable movement of each of the upper and lower edges relative to the collector.

The wiper assembly may further include an extension member that extends between the support member and the arm member and is configured to limit side-to-side movement of the wiper relative to the support frame.

The wiper assembly may be in combination with a concrete mixer having the rotatable barrel, the collector, and the support frame, wherein the wiper assembly is removably coupled to the support frame and the upper edge of the concrete direction member is in contact with the rotatable barrel.

According to yet another embodiment, a wiper assembly is used with a concrete mixer having a rotatable barrel with a discharge opening at one end, a collector disposed below the discharge opening, the collector having an upwardly facing collecting opening to receive concrete from the discharge opening, and a support frame to which the collector is mounted. The wiper assembly includes a wiper being formed of a flexible, resilient material and having a first end and a second end and an arcuate portion extending between the first and second ends. The arcuate portion has an upper edge proportioned to engage the rotatable barrel adjacent the discharge opening of the rotatable barrel. The wiper further includes a lower edge disposed opposite the upper edge proportioned to be received within the upwardly facing collecting opening of the collector. An arm member is coupled to one of the first and second ends and the support frame. The arm member includes an elastic portion that is elastically deformable and that enables movement of the wiper relative to the rotatable barrel and to the collector, and a tensioning portion that adjusts to move the upper edge of the arcuate portion of the wiper into contact with the rotatable barrel.

The wiper assembly may further include a first arm member coupled between the first end and the support frame and a second arm member coupled between the second end and the support frame.

The wiper assembly may further include a hole extending therethrough, a rivet received in the hole, and the arm member received through the rivet.

The wiper assembly may further include an extension member that extends between the support member and an intermediate section of the arm member to limit side-to-side movement of the wiper relative to the support frame, the intermediate section of the arm member being disposed between a proximal end of the arm member coupled to the gap spanning portion and a distal end of the arm member that couples to the support member and that is disposed opposite the proximal end.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other objects, advantages and features of the invention will become apparent from the following detailed description of the invention when considered in conjunction with the drawings.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION

The principles of the present disclosure have particular application to a wiper assembly for directing a flow of concrete flowing from a mixer barrel of a concrete mixer vehicle. Of course, the principles of the disclosure may be useful with other non-vehicular concrete mixers, such as small batch mixers, or with mixers of other construction materials, such as asphalt.

Figure 1:
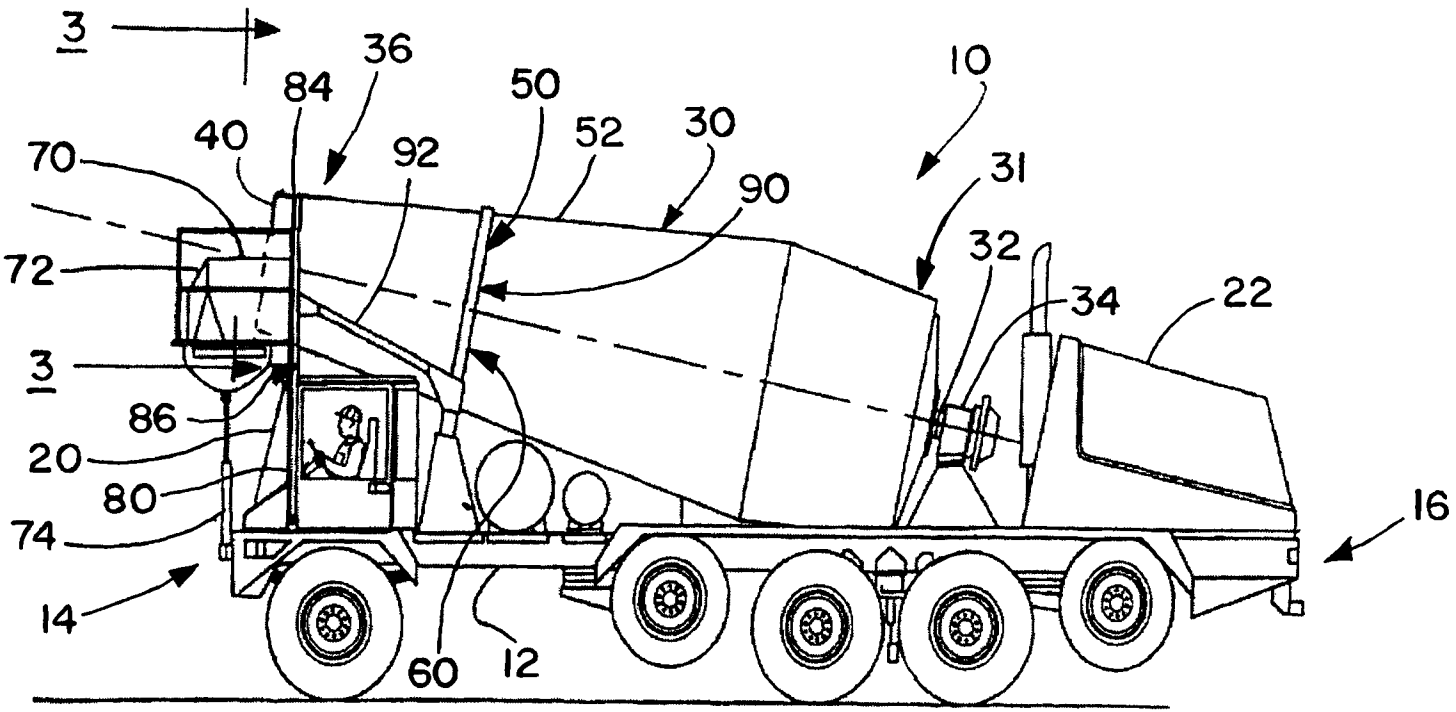
FIG. 1 shows a side elevation view of a concrete mixer including an exemplary barrel wiper assembly according to one embodiment of the invention.
Figure 2:
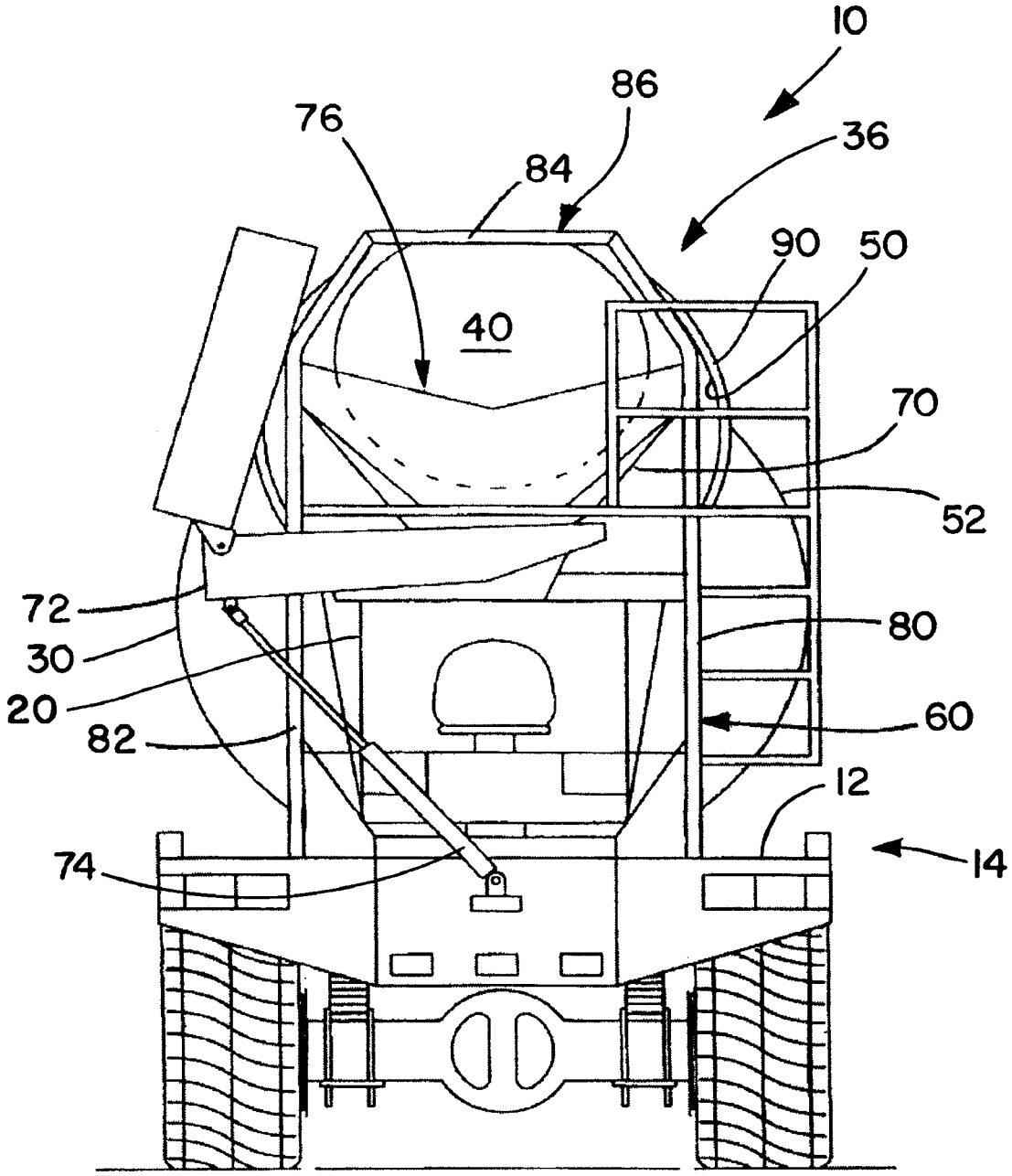
FIG. 2 shows front elevation view of the concrete mixer and the exemplary barrel wiper assembly of FIG. 1.

Referring now in detail to FIGS. 1 and 2, a concrete mixer, such as a front-discharge concrete mixer vehicle 10, is illustrated, which also may be referred to as a concrete mixer 10. The concrete mixer 10 includes a vehicle frame 12 extending from a front end 14 to a rear end 16. A control cab 20 is disposed at the front end 14 opposite a power train compartment 22 disposed at the rear end 16. The control cab 20 includes driving controls, such as a steering wheel and gear shifter, and mixer controls for controlling concrete mixing and discharge components of the concrete mixer 10. In other embodiments the control cab 20 may include only one of the driving controls and mixer controls and the other of the driving controls and the mixer controls may be located elsewhere on the concrete mixer 10.

The power train compartment 22 includes an engine for powering the concrete mixer 10 and power train components that couple the engine to the wheel axles of the concrete mixer 10. In other concrete mixer embodiments, such as in a rear-discharge mixer, the power train compartment 22 and control cab 20 may each be disposed at the front end of the concrete mixer.

Disposed between the control cab 20 and the power train compartment 22 is a rotatable mixer barrel 30, which also is referred to as a mixer barrel 30, a rotatable barrel, or simply a barrel 30 or a drum 30. The mixer barrel 30 is supported at its rear, non-discharge end 31 by a gearbox shaft 32, which is coupled to a gearbox 34. As used herein, the term coupling may refer to a direct or an indirect coupling of components. The gearbox 34 is coupled to the engine of the power train compartment 22 for moving gears in the gearbox 34, to effect rotation of the gearbox shaft 32 and of the mixer barrel 30. In other embodiments, the mixer barrel 30 may be rotated by any other suitable prime mover, which may be separate from the engine that powers the drive train of the concrete mixer vehicle 10.

The mixer barrel 30 is disposed at an upwards acute angle with a discharge end 36 being elevated higher than the opposite rear, non-discharge end 31. The discharge end 36 includes a discharge opening 40 that allows concrete to flow out of an interior of the mixer barrel 30.

The mixer barrel 30 includes an interior contour that is configured, such as shaped with a raised, spiral mixing ridge or fluting (not shown), for mixing concrete within the interior of the mixer barrel 30 when the barrel 30 is rotated in a non-discharge mixing direction. The interior contour is configured to churn flowable, un-cured concrete within the mixer barrel 30. The interior contour also is configured to drive the concrete upwards towards the discharge end 36 to create a flow of concrete from the mixer barrel 30 when the barrel 30 is rotated in a discharge direction opposite the mixing direction. When the barrel 30 is rotated in the mixing direction opposite of the discharge direction the flowable concrete is driven towards the rear, non-discharge end 31 of the mixing barrel 30.

Due to the configuration of the internal contour of the barrel 30, the barrel 30 need not be lifted and/or the discharge end 36 tilted in a downwards direction to enable concrete to flow from a discharge opening 40, which is disposed at the discharge end 36. Though in other embodiments, movable members may be coupled to the vehicle frame 12 for tilting the mixer barrel 30 and/or for translating one or both of the discharge and rear ends 36 and 31 along respective vertical axes of the concrete mixer vehicle 10.

As shown, the barrel 30 includes a track 50 disposed about an external barrel surface 52, such as located about three-quarters of the distance from the gearbox shaft 32 to the discharge opening 40. A set of rotatable members, such as antifriction wheels (not shown), engage the barrel 30 at the track 50 for supporting the mixer barrel 30 during its rotation relative to the vehicle frame 12. Any other suitable rotatable members may be used in other embodiments, such as bearings.

The rotatable members are disposed between a support frame 60 and the external barrel surface 52. The support frame 60 supports the discharge end 36 of the barrel 30 and assists in maintaining side-to-side location of the barrel 30. The support frame 60 is coupled, such as welded, to the vehicle frame 12.

A collector 70 is attached to the support frame 60 and receives the flow of concrete discharged from the mixer barrel 30. When the barrel 30 rotates in the discharge direction, the concrete climbs along an internal spiral and spills out of the discharge opening 40 of the barrel 30. The collector 70 has an upwardly facing collecting opening 76 disposed substantially below the discharge opening 40 for receiving the flow of concrete discharged from the barrel 30. Concrete falling into the collecting opening 76 then moves along an internal surface 78 (FIG. 3) of the collector 70 and towards the chute 72.

The chute 72 is movable via movable chute members 74, which are controllable, such as via controls in the control cab 20. As shown, the movable chute members 74 are hydraulic pistons which may be rotatable via any suitable rotating means, such as a motor. In other embodiments the movable chute members 74 may be pneumatic linear actuators, rod and screw actuators, etc.

The collector 70 and the chute 72 are coupled to and thus supported by the support frame 60, which includes oppositely disposed members 80 and 82 that rise generally vertically alongside opposite sides of the discharge opening 40 of the barrel 30. A crossmember 84 is coupled, such as welded, between the oppositely disposed members 80 and 82.

The members 80 and 82, and the crossmember 84, make up a forward portion 86 of the support frame 60 supporting the collector 70 and the chute 72 and are coupled to a rear portion 90 of the support frame 60 supporting the barrel 30. The two portions 86 and 90 are coupled via crosspieces 92, which are shown as disposed adjacent, such as over, the control cab 20.

Due to the typical construction of the support frame 60, movement of the barrel 30, such as side-to-side movement, may cause the support frame 60 to flex, thus resulting in lateral, side-to-side movement of the collector 70 relative to the discharge opening 40. Forces, such as jostling forces, causing the barrel 30 to move laterally, side-to-side or horizontally may be caused by driving of the mixer 10 over uneven and/or rough terrain. The churning of the concrete within the barrel 30 may also cause uneven forces to affect different locations along the circumference of the rotating barrel 30, also causing movement, such as lateral shifting, of the barrel 30 relative to the support frame 60.

As a result of movement of the barrel 30, the discharge opening 40 may move relative to the collector 70. This may result in concrete missing the collector 70 and spilling onto the control cab 20 of the depicted front-discharge mixer 10, or to the ground in a rear-discharge mixer. The concrete may also trickle down the exterior surface 52 of the barrel, potentially contaminating the rotatable members and/or other movable members (not shown) and substantially affecting controlled rotation of the barrel 30 and thus mixing of concrete within the barrel 30.

Figure 3:
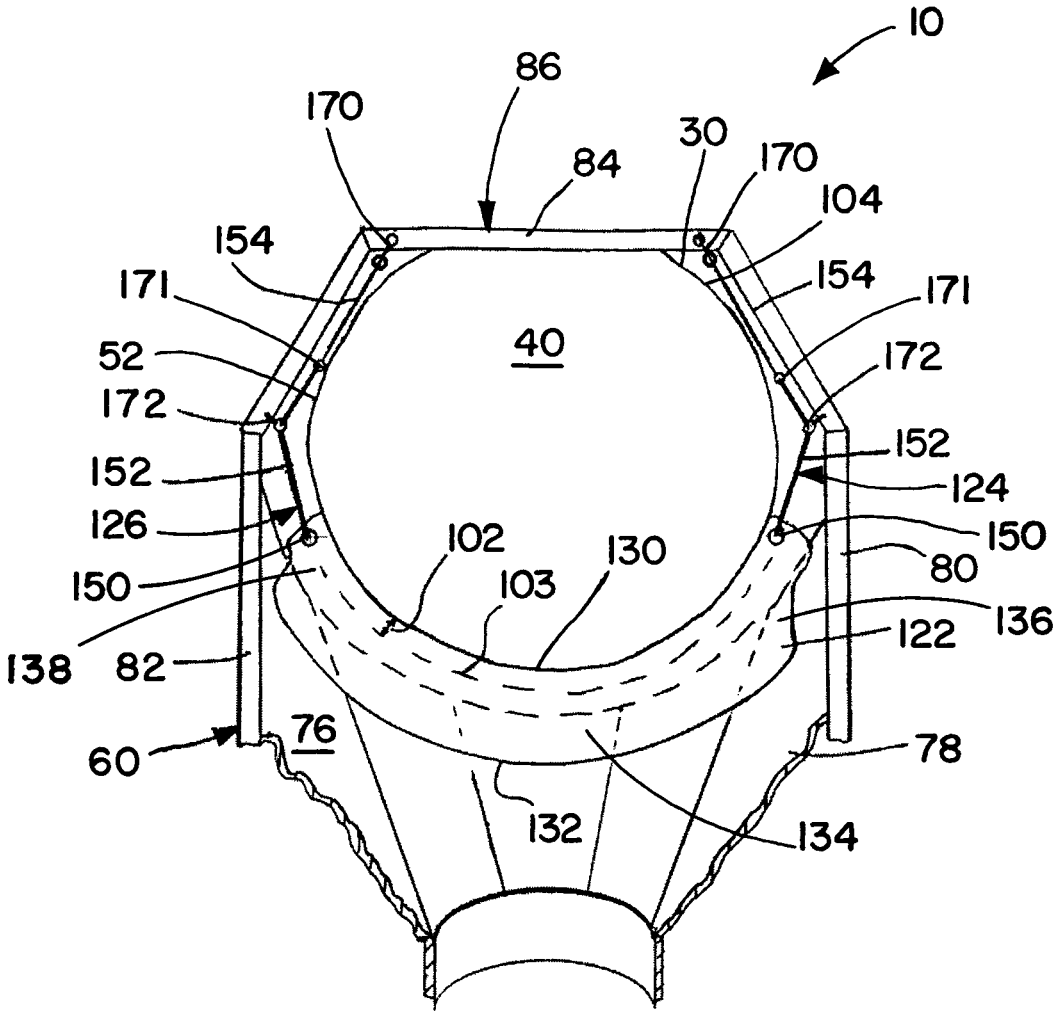
FIG. 3 is a cross-sectional view looking generally in the direction of arrows 3-3 of FIG. 1, showing another front elevation view of the concrete mixer and the exemplary barrel wiper assembly of FIG. 1.

Turning now to FIG. 3, there is also a gap 102 disposed between an upper edge 104 of the collector 70, disposed adjacent the discharge opening 40, and an external periphery 104 of the barrel 30, disposed about the discharge opening 40. The gap 102 is present because the discharge end 36 can move relative to the collector 70, as mentioned, and because the discharge end rotates relative to the collector 70. Concrete flowing from the discharge opening 40 can flow into the gap 102, instead of into the collecting opening 76, and thus can fall onto the rotatable members, external surface 52 of the barrel 30, or control cab 20, for example, causing any of the aforementioned issues.

To maintain the flow of concrete in a direction from the discharge opening 40 into the collecting opening 76, the depicted concrete mixer 10 includes a wiper assembly 120 in accordance with the invention. The wiper assembly 120 includes a wiper element 122 and first and second arm members 124 and 126. The wiper assembly 120, and preferably the wiper element 122, is configured to span the gap 102, and preferably to cover a substantial portion of the gap 102. The wiper assembly 120 also is configured to direct substantially all of the flow of concrete from the discharge opening 40 to the collecting opening 76.

In general, the wiper assembly 120 is suspended from the concrete mixer 10 such that it moves relatively freely in relation to the rotatable mixer barrel 30, the collector 70, and the support frame 60. The wiper assembly 120 generally is configured to allow limited side-to-side movement of the wiper element 122 along a lateral axis extending between the members 80 and 82.

Figure 4:
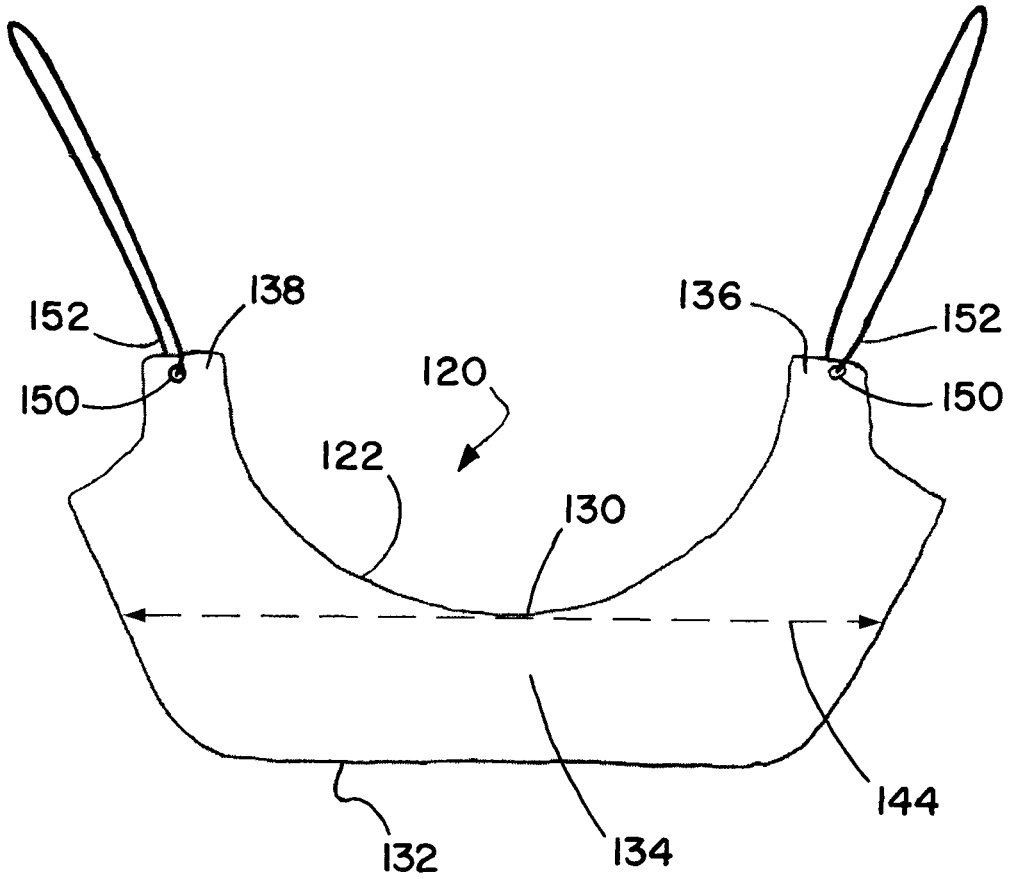
FIG. 4 shows a portion of the barrel wiper assembly of FIG. 1.

Referring now to both FIGS. 3 and 4, the wiper element 122, which is also herein referred to as a gap spanning portion 122, a concrete direction portion 122, a wiper portion 122, or a wiper 122, spans the gap 102 between the upper edge 103 of the collector 70 and a lower periphery portion of the external periphery 104 of the barrel 30. In this way, the presence of the wiper element 122 facilitates the flow of concrete from the mixer barrel 30 into the collector 70, and as a result, substantially prevents errant concrete from falling onto the rotatable members, external surface 52 of the barrel 30, and/or control cab 20, for example.

The wiper element 122 is configured for contact with each of the mixer barrel 30 and the collector 70, and particularly for contact with the lower periphery of the mixer barrel 30 and the internal surface 78 of the collector 70. An upper edge 130 of the wiper element 122 is configured to contact the barrel 30 and a lower edge 132 of the wiper element 122 is configured to contact the collector 70.

The wiper element 122 is at least partially composed of a flexible, resilient material. The resilient material may include rubber, or any other suitable material, such as a suitable elastic material. The resilient material may be reinforced, such as by fabric, for example, nylon. In this way, the upper edge 130 may be flexed to conform to the lower periphery of the barrel 30, and the lower edge 130 may be concurrently flexed to conform to the internal surface 78 of the collector 70, as will be further explained.

The depicted wiper element 122 has a uniform thickness, such as 0.25 inches to 1 inch, and more preferably is ⅜ inch thick. In this way, the wiper element 122 may be formed from a sheet material, such as a resilient sheet material. In other embodiments, the wiper element 122 may not have a uniform thickness throughout. For example, the upper edge 130 may have a greater thickness than the lower edge 132, such that the thickness is continuously reduced along a distance between the upper edge 130 and the lower edge 132. Thus the lower edge 132 may have a feathered distal surface for contacting the collector 70.

The upper edge 130 of the wiper element 122 is configured, such as shaped, to extend about the external periphery 104 of the barrel 30, and may extend about at least one quarter to one half of the external periphery 104, and more preferably about one third of the external periphery 104. In other words, the upper edge 130 is proportioned to engage the barrel 30 adjacent the discharge opening 40.

The upper edge 130 may have different proportions depending on the external periphery shape of the respective barrel 30 with which it is used. For example, the depicted wiper element 122 has an arcuate upper edge 130 to conform to an adjacent external surface of the barrel 30. In other embodiments, the upper edge 130 may have any other suitable shape.

The depicted lower edge 132 of the wiper element 122 also has an arcuate shape, which is configured, such as proportioned, to be received into the upwardly facing collecting opening 76 and to conform to a contour of the internal surface 78 of the collector 70. The length and shape of the lower edge 132 is not configured in relation to the upper edge 130, but to the contour of the internal surface of the collector 70. In other embodiments, the lower edge 132 may have any other suitable shape, such as being configured in relation to the upper edge 130.

A central portion 134, such as the illustrated arcuate central portion 134, extends vertically between the upper and lower edges 130 and 132. The central portion 134 also extends laterally between a first lateral side 136 and an oppositely disposed second lateral side 138 of the wiper element 122. Thus the side-to-side movement of the wiper element 122 may be along a lateral axis extending between the lateral sides 136 and 138.

A length 144 (FIG. 4) of the central portion 134 extends between the first and second lateral sides 136 and 138 and, in the depicted embodiment, is configured to be fully received within the collecting opening 76 of the collector 70. In other embodiments, the length 144 may be configured, such as shaped, to extend laterally outwardly beyond sides of the collector 70.

As depicted, the length 144 also is preferably configured, such as shaped, to extend laterally outwardly beyond the external periphery 104 of the rotatable mixer barrel 30. In this way, the flow of concrete flowing from the discharge opening 40 will be substantially directed onto the wiper element 122 and into the collector 70, rather than to either side of the wiper element 122.

The depicted wiper element 122 is coupled, and preferably removably coupled, to the concrete mixer 10 via the arm members 124 and 126. Though in other embodiments, only one arm member 124 or 126 may be used. The arm members 124 and 126 may be coupled in any suitable way to the wiper element 122, such as by welding, adhesives, mechanical attachment such as fasteners, etc. The depicted wiper element 122 includes fasteners 150 extending therethrough, such as rivets extending through a hole in each of the first lateral side 136 and the second lateral side 138. The fasteners 150 are configured to receive respective connecting portions of the arm members 124 and 126.

The arm members 124 and 126 are disposed adjacent the barrel 30 and extend between the wiper element 122 and the support frame 60. Particularly, the first arm member 124 extends along a first side of the barrel 30 and is coupled to a first end of the forward portion 86, such as to a first end of the crossmember 84. The second arm member 126 extends along an oppositely disposed second side of the barrel 30 and also is coupled to the crossmember 84, such as to a second end of the cross member 84. As will be further explained, the first and second members 124 and 126 also are respectively coupled to the members 80 and 82 of the support frame 60.

In some embodiments either of the arm members 124 and 126 may be coupled to either of the first and second ends of the forward portion 86. In other embodiments, each of the first and second arm members 124 and 126 may be coupled to any other suitable portion of the support frame 60.

At least one of the arm members 124 and 126 is selectively adjustable to align the wiper element 122 across the gap 102 between the mixer barrel 30 and the collector 70. In the depicted embodiment, both of the arm members 124 and 126 are selectively adjustable.

At least one of the arm members 124 and 126 is configured to allow the limited side-to-side movement of the wiper element 122 along a lateral axis, which may extend between the members 80 and 82 and/or between the first and second lateral sides 136 and 138. For example, the arm members 124 and 126 are constructed to enable hanging, also herein referred to as suspending, of the depicted wiper element 122 relative to each of the support frame 60, the collector 70, and the mixer barrel 30. In this way, the wiper element 122 is not integrally fixed to either of the barrel 30 or the collector 70. The two depicted arm members 124 and 126 are configured to allow the suspended movement and to maintain movement freedom of the wiper element 122 relative to each of the barrel 30 and the collector 70 because neither of the arm members 124 nor 126 is coupled directly to the barrel 30 and/or to the collector 70.

Further, each of the depicted arm members 124 and 126 includes an elastic portion 152 and a tensioning portion 154. In other embodiments, one of the arm members 124 and 126 may include an elastic portion 152 and the other of the arm members 124 and 126 may include a tensioning portion 154. In even other embodiments, only one of the arm members 124 and 126 may include both an elastic portion 152 and a tensioning portion 154, while the other of the arm members 124 and 126 may include one of or neither of an elastic portion 152 and a tensioning portion 154.

Referring now only to one of the elastic portions 152, but applicable to both elastic portions 152, the elastic portion 152 enables the wiper element 122 to temporarily adjust its position relative to each of the support frame 60, the rotatable barrel 30 and the collector 70 during rotation of the mixer barrel 30 and/or during flexing of the support frame 60 causing movement of the collector 70. Thus, in general, each of the upper and lower edges 130 and 132 is movable relative to the collector 70 and to the mixer barrel 30.

The elastic portion 152 is configured to extend and retract relative to the support frame 60 to which it is coupled. For example, the elastic portion 152 is made of a suitable resilient material, such as rubber, polyurethane, etc. Preferably, the elastic portion 152 is made of a suitable elastically deformable material. The depicted elastic portion 152 includes a polyurethane element, such as a polyurethane cord or tube, having its ends coupled together, such as by welding, vulcanizing, or adhesives. In other embodiments, the elastic portion 152 may be any suitable resilient member, such as a bungee cord.

One end of the elastic portion 152 is looped through the fastener 150 of the wiper element 122. An oppositely disposed end of the elastic portion 152 is coupled to the respective tensioning portion 154, which is in turn coupled to the support frame 60.

Referring now only to one of the tensioning portions 154, but applicable to both tensioning portions 154, the tensioning portion 154 is selectively adjustable to adjust alignment of the upper edge 130 of the wiper element 122 relative to the support frame 60, and to move the upper edge 130 into contact, such as conformal contact, with the rotatable barrel 30. For example, the tensioning portion 154 is adjustable to adjust and set a tension of the tensioning portion 154. Increasing the tension of the tensioning portion 154 causes the upper edge 130 to flex about the external periphery 104 of the mixer barrel 30. The flexing may enable a dynamic seal to form between the upper edge 130 and the rotatable mixer barrel 30.

The tensioning portion 154 may be any suitable component that is selectively adjustable. As shown, the tensioning portion 154 is an adjustable loop, such as a zip tie, and for example a heavy-duty zip tie. In other embodiments the tensioning portion 154 may be a turnbuckle.

As shown, one end of the tensioning portion 154 is coupled to the elastic portion 152. An oppositely disposed end of the tensioning portion 154 is coupled to the support frame 60.

The tensioning portion 154 of each arm member 124 and 126 is coupled to the support frame 60 and to the respective elastic portion 152. And the elastic portion 152 of each arm member 124 and 126 is coupled to the respective tensioning portion 154 and to the respective lateral end 136 or 138 of the wiper element 122. In other embodiments, the coupling order of one or both of the tensioning portion 154 and elastic portion 152 of one or both arm members 124 and 126 may be reversed. The two tensioning portions 154 may include different tensioning components and/or the two elastic portions 152 may include different elastic components.

The tensioning portions 154 and elastic portions 152 are coupled to one another and to the support frame 60 via suitable fasteners. As shown, the fasteners include eyebolts 170 and eyeloops 171, though any other suitable fasteners may be utilized. The eyebolts 170 are threaded and are thus screwed into holes in the support frame 60.

The wiper assembly 120 also includes extension members 172 extending between the respective arm members 124 and 126 and the support frame. As shown, the extension members 172 are coupled to the members 80 and 82 and also to intermediate sections of each of the respective arm members 124 and 126.

The intermediate sections are disposed between proximal ends of the elastic portions 152 and distal ends of the elastic portions 152 disposed opposite the proximal ends. The proximal ends of the elastic portions 152 are coupled to the wiper element 122. The distal ends of the elastic portions 152 are coupled to the support frame 60 via the respective tensioning portions 154 and eyebolts 170.

In this way, side-to-side movement of the elastic portions 152, and thus of the wiper element 122, is limited to controlled movement of the wiper element 122, where generally excessive movement could cause disengagement of the wiper element 122 from a rotating mixer barrel 30. The extension members 172 also function to move the elastic portions 152 out of contact with the rotating barrel 30 to prevent frictional wear of the elastic portions 152 caused by the barrel 30.

Through use of the described hanging wiper assembly 120, including the wiper element 122 and the arm members 124 and 126, the flow of concrete from the barrel 30 may be substantially directed into the collector 70. The construction of the wiper assembly 120 enables easy removal and replacement of worn components. The resilient materials used prevent concrete from permanently attaching to the wiper assembly 120 via continuous flexing of the resilient materials. Further, the construction of the wiper assembly 120 reduces wear of each of the components, including the wiper element 122 by enabling freedom of movement of the wiper element 122 relative to the barrel 30 and to the collector 70. The use of the elastic portion 152 and the tensioning portion 154 enables (a) continuous engagement of the wiper element 122 with both the collector 70 and the barrel 30 during movement of either the barrel 30 and/or the collector 70 in the same or different directions, concurrently with (b) the aforementioned suspended movement of the wiper element 122 relative to each of the collector 70 and the mixer barrel 30.

As depicted, the wiper assembly 120 is used with the front-discharge concrete mixer vehicle 10, but it may be used with a rear-discharge mixer. Those of ordinary skill in the art will know how to shape and proportion the wiper assembly 120 to be used with a rear-discharge mixer, or even with any other mixer or shape of mixer barrel.

In summary, an exemplary wiper assembly 120 for use with a concrete mixer 10 includes a wiper element 122 configured to span a gap 102 between a mixer barrel 30 and a collector 70, and is configured for suspendedly coupling to a support frame 60 separate from any coupling to the mixer barrel 30 or the collector 70. One or more arm members 124/126 are coupled between the concrete mixer 10 and the wiper element 122. The arm member 124/126 includes a tensioning portion 154 that adjusts to move an upper edge 130 of the wiper element 122 into contact with the mixer barrel 30, and an elastic portion 152 that enables the wiper element 122 to adjust relative to each of the collector 70 and the mixer barrel 30 during rotation of the mixer barrel 30. Thus the wiper element 122 has limited movement independent of rotation of the mixer barrel 30 and of vibrational movement of the collector 70 and mixer barrel 30 due to movement of the concrete mixer 10 over rough terrain, for example.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A wiper assembly for use on concrete mixer, the concrete mixer having a rotatable barrel with a discharge opening at one end, a collector disposed below the discharge opening, the collector having an upwardly facing collecting opening to receive concrete from the discharge opening, and a support frame to which the collector is mounted, the wiper assembly including:

a gap spanning portion that extends between a lower periphery of the rotatable barrel adjacent the discharge opening and an upper periphery of the collector adjacent the collecting opening, the gap spanning portion configured for contact with each of the rotatable barrel and the collector;

a first arm member that couples between a first lateral side of the gap spanning portion and the support frame; and a second arm member that couples between the support frame and a second lateral side of the gap spanning portion disposed opposite the first lateral side;

wherein one of the first and second arm members is selectively adjustable to align the gap spanning portion across a gap between the rotatable barrel and the collector, and wherein one of the first and second arm members is configured to suspend the gap spanning portion relative to the rotatable barrel and to the collector to allow side-to-side movement of the gap spanning portion along a lateral axis extending between the first and second lateral sides relative to the rotatable barrel and the collector.

2. The wiper assembly of claim 1, wherein one of the first and second arm members includes a tensioning portion that adjusts to move an upper edge of the gap spanning portion into contact with the rotatable barrel.

3. The wiper assembly of claim 2, wherein the tensioning portion includes a zip tie.

4. The wiper assembly of claim 1, wherein one of the first and second arm members includes an elastic portion that enables the gap spanning portion to adjust relative to each of the frame and the rotatable barrel during rotation of the rotatable barrel.

5. The wiper assembly of claim 4, wherein the elastic portion includes an elastic loop extending between the support frame and the gap spanning portion.

6. The wiper assembly of claim 1, wherein each of the first and second arm members includes a tensioning portion that adjusts to move an upper edge of the gap spanning portion into contact with the rotatable barrel upon setting of a tension of the tensioning portion and an elastic portion that enables that gap expanding portion to adjust relative to each of the frame and the rotatable barrel during rotation of the rotatable barrel.

7. The wiper assembly of claim 1, wherein the gap spanning portion has a length extending between the first and second lateral sides that is configured to extend laterally outwardly beyond the periphery of the rotatable barrel adjacent the discharge opening.

8. The wiper assembly of claim 1, wherein the gap spanning portion includes a resilient material.

9. The wiper assembly of claim 1, further including fasteners that couple the first and second arms to the support frame.

10. The wiper assembly of claim 1, further including extension members that extend between the support member and each of the first and second arm members, respectively, to limit side-to-side movement of the gap spanning portion relative to the support frame.

11. The wiper assembly of claim 1, wherein the gap spanning portion includes a lower edge that is configured to be fully received within the upwardly facing collecting opening of the collector.

12. The wiper assembly of claim 1, wherein the gap spanning portion has an upper edge having an arcuate shape and a lower edge having an arcuate shape.

13. The wiper assembly of claim 1, in combination with a concrete mixer having the rotatable barrel, the collector, and the support frame, wherein the wiper assembly is removably coupled to the support frame and an upper edge of the gap spanning portion is in contact with the rotatable barrel.

14. A wiper assembly for use on concrete mixer, the concrete mixer having a rotatable barrel with a discharge opening at one end, a collector disposed below the discharge opening, the collector having an upwardly facing collecting opening to receive concrete from the discharge opening, and a support frame to which the collector is mounted, the wiper assembly including:

a concrete direction member having an arcuate upper edge configured to extend about a periphery of the rotatable barrel adjacent the discharge opening, a lower edge configured to be received into the collecting opening and to conform to a contour of an inner surface of the collector, and a center portion extending between the upper and lower edges that is configured to cover a gap spanning between the rotatable barrel and the collector; and an arm member coupled between the concrete direction member and the support frame, the arm member having an elastic portion configured to extend and retract and a tensioning portion configured to selectively adjust alignment of the concrete direction member relative to the collector, and the arm member being configured to enable movement of each of the upper and lower edges relative to the collector.

15. The wiper assembly of claim 14, further including an extension member that extends between the support member and the arm member and is configured to limit side-to-side movement of the wiper relative to the support frame.

16. The wiper assembly of claim 14, in combination with a concrete mixer having the rotatable barrel, the collector, and the support frame, wherein the wiper assembly is removably coupled to the support frame and the upper edge of the concrete direction member is in contact with the rotatable barrel.

17. A wiper assembly for use on concrete mixer, the concrete mixer having a rotatable barrel with a discharge opening at one end, a collector disposed below the discharge opening, the collector having an upwardly facing collecting opening to receive concrete from the discharge opening, and a support frame to which the collector is mounted, the wiper assembly including:

a wiper being formed of a flexible, resilient material and having a first end and a second end and an arcuate portion extending between the first and second ends, wherein the arcuate portion has an upper edge proportioned to engage the rotatable barrel adjacent the discharge opening of the rotatable barrel, and wherein the wiper further includes a lower edge disposed opposite the upper edge proportioned to be received within the upwardly facing collecting opening of the collector; and an arm member coupled between one of the first and second ends and the support frame, the arm member including an elastic portion that is elastically deformable and that enables movement of the wiper relative to the rotatable barrel and to the collector, and a tensioning portion that adjusts to move the upper edge of the arcuate portion of the wiper into contact with the rotatable barrel.

18. The wiper assembly of claim 17, further including a first arm member coupled between the first end and the support frame and a second arm member coupled between the second end and the support frame.

19. The wiper assembly of claim 17, wherein the wiper further includes a hole extending therethrough, a rivet received in the hole, and the arm member received through the rivet.

20. The wiper assembly of claim 17, further including an extension member that extends between the support member and an intermediate section of the arm member to limit side-to-side movement of the wiper relative to the support frame, the intermediate section of the arm member being disposed between a proximal end of the arm member coupled to the gap spanning portion and a distal end of the arm member that couples to the support member and that is disposed opposite the proximal end.

* * * * *